United States Patent [19]

Riedel

[11] 3,943,735

[45] Mar. 16, 1976

[54] CONTINUOUS DECATIZING MACHINE

[75] Inventor: Dieter Riedel, Hausberge, Porta, Germany

[73] Assignee: Drabert Sohne, Westphalia, Germany

[22] Filed: Nov. 6, 1974

[21] Appl. No.: 521,441

[30] Foreign Application Priority Data

May 28, 1974 Germany ..... 2425738

[52] U.S. Cl. ..... 68/5 R; 34/115; 34/118; 34/122; 100/153

[51] Int. Cl.² ..... D06B 5/08

[58] Field of Search ..... 68/5 D, 5 E, 8, 5 R, 5 B; 8/149.3; 34/115, 116, 118, 122, 123; 100/151–154, 93 RP, 118, 121

[56] References Cited

UNITED STATES PATENTS

| | | | |
|---|---|---|---|
| 2,174,744 | 10/1939 | Hill | 34/122 X |
| 2,885,875 | 5/1959 | Sperotto | 68/5 D X |
| 3,110,612 | 11/1963 | Gottwald et al. | 34/116 X |
| 3,783,097 | 1/1974 | Justus | 100/121 X |

FOREIGN PATENTS OR APPLICATIONS

| | | | |
|---|---|---|---|
| 587,866 | 11/1933 | Germany | 34/123 |

*Primary Examiner*—Harvey C. Hornsby
*Assistant Examiner*—Philip R. Coe
*Attorney, Agent, or Firm*—Mason, Mason & Albright

[57] ABSTRACT

A continuous decatizing machine comprises a perforated decatizing cylinder supplied with steam. A fabric web to be decatized is passed around the cylinder and is pressed against the cylinder by means of backing cloths. Pressure is applied to the backing cloths by means of strips which are impermeable to steam.

9 Claims, 4 Drawing Figures

CONTINUOUS DECATIZING MACHINE

BACKGROUND OF THE INVENTION

1. Field of the Invention

The present invention relates to a continuous decatizing machine.

2. Description of the Prior Art

German Offenlegunschrift No. 2,148,311 relates to a continuous decatizing machine, with a rotatable and heatable decatizing cylinder, the wall of which has a plurality of holes. A backing cloth is applied against the material to be processed, along a portion of the circumference of the cylinder. This backing cloth consists of a material which is impermeable to air, and the holes in the cylinder wall communicate with a low-pressure source to produce a suction action from outside inwards.

Due to the different flow conditions prevailing in the area between the holes of the cylinder and the cylinder surfaces lying therebetween, the processed material is not likely to be of uniform quality; indeed, the material, as regards appearance, brightness, and feel, will exhibit differences and will be unattractive.

In addition, the use of a backing cloth which is impermeable to air, adversely affects the surface of the material to be treated. In this respect, since the inner side of the backing cloth facing the material to be decatized must be in the form of a textile material, the outer side of the backing cloth consists of rubber or other impermeable material, the backing cloth thus being of multilayer constructions. However, practice has shown that with such a backing cloth, surface pressures in excess of 0.5 kp/cm$^2$ causes lines and patterns to be formed on the inner surface structure of the backing cloth, and render the decatized material, at least in the case of materials dyed in the piece, unusable.

In addition the inner side of the backing cloth is exposed to very considerable wear with the result that the working life of the backing cloth is relatively short, and the backing cloth is relatively expensive to replace owing to its multi-layer construction.

In this previously proposed machine, moistening of the material by water or the like occurs before processing on the heated cylinder. Firstly, the absorption of moisture by the material during relatively fast operation is not at an optimum value. The moisture supplied is provided only on the surface and on one side of the material, and as the time of operation is short, it does not penetrate to the inside of the assembly of fibres. Thus, with the surface pressure treatment, an adequate fixing effect cannot be obtained. Therefore material thus produced is not shrink-resistant.

Further, the decatizing effect is provided only on a single side. The evaporation of the water introduced takes place spontaneously under the vacuum conditions so that with continued processing increasing amounts of moisture are removed from the material, and the material is subject to considerable drying-out as a result of the surface pressure and the heat effects. As a consequence of this phenomenon, a single-side decatizing effect is produced with an undesirable high gloss. The drying-out of the material causes the material to have a brittle feel, as a result of which the thickness of the material is reduced considerably.

The moistening of the material with water or the like before the decatizing treatment is non-uniform due to soiling and blockages in the moistening units, brought about by chalk deposits or the like as a result of continued operation of the machine. Non-uniform moistening, in turn, leads to non-uniform decatizing effects.

An object of the invention is to improve this previously proposed machine in such a manner that throughout the entire material, and on both sides of it, a uniform and permanent gloss, a pleasant feel and, in addition, complete shrink stability are obtained.

SUMMARY OF THE INVENTION

According to the present invention, there is provided in a continuous decatizing machine, a rotatable, heatable, decatizing cylinder, the cylinder having a circumferential wall provided with holes distributed over the wall, said holes being fed with steam, means for feeding material to be decatized around the cylinder, backing cloths applied against the material around a portion of the cylinder, and two heatable pressure strips, said strips being impermeable to steam, each said strip being applied against a respective backing cloth over an arc of less than 180°.

Advantageously the two pressure strips are brought to temperatures of at least 100°C by suitable heating means.

In a preferred embodiment of the invention, each backing cloth is freely removable from the associated pressure strip, in such a manner that outside the working zone of the pressure strips, the paths of the backing cloths diverge from those of the pressure strips.

Preferably, the pressure strips are in the form of endless pressure bands which pass over tensioning rollers. In this manner, the applied pressure can be adjusted to suit the type of material to be treated. In this case the strips are formed of steel, in particular stainless steel, since during operation it is necessary to work with relatively high tensioning forces.

In order to ensure even moistening of the material, a sleeve can be disposed around the decatizing cylinder, the sleeve advantageously being composed of felt.

In order to obtain mark-free decatization of the material, the backing cloths are preferably jointless and endless and are made of satin fabric or like material.

Since the backing cloths are urged by means of the pressure strips against the material to be decatized, longitudinal tensioning of the backing cloths can be avoided, thus leading to an increased working life.

BRIEF DESCRIPTION OF THE DRAWINGS

Embodiments of the invention will now be described, by way of example only, with reference to the accompanying diagrammatic drawings, in which.

DESCRIPTION OF THE PREFERRED EMBODIMENTS

Figure 1:
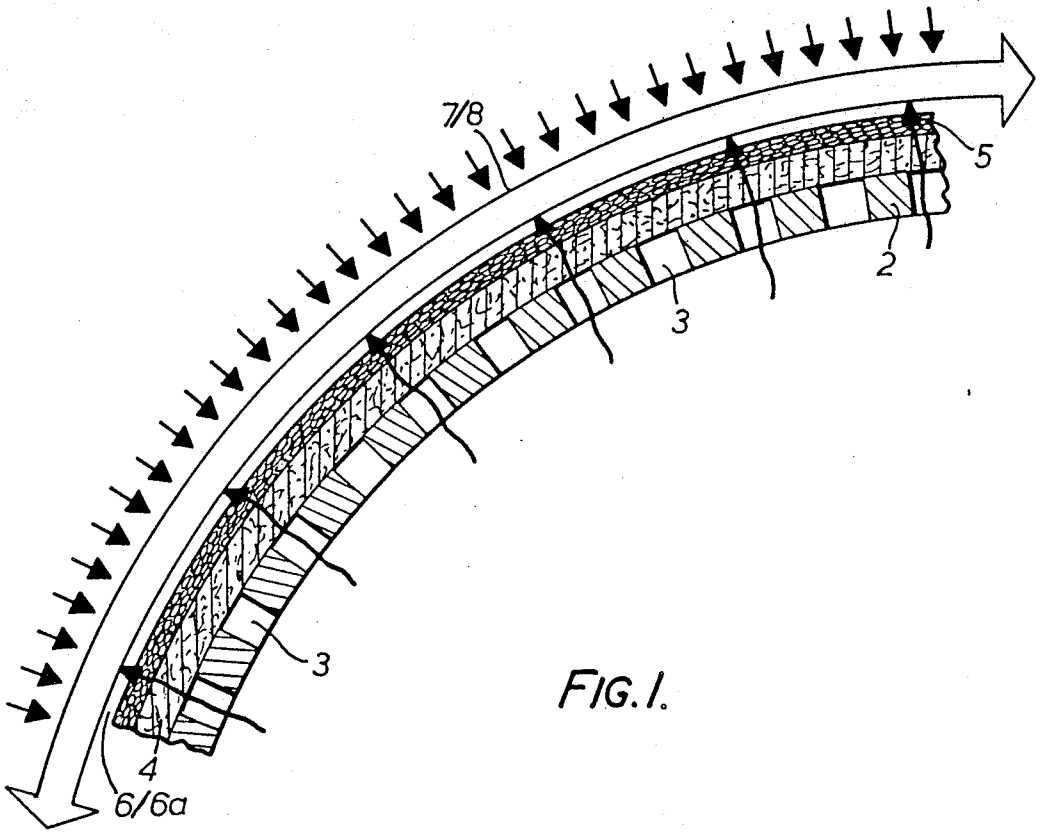
FIG. 1 is a fragmentary section of a decatizing cylinder of a decatizing machine in accordance with the invention.
Figure 2:
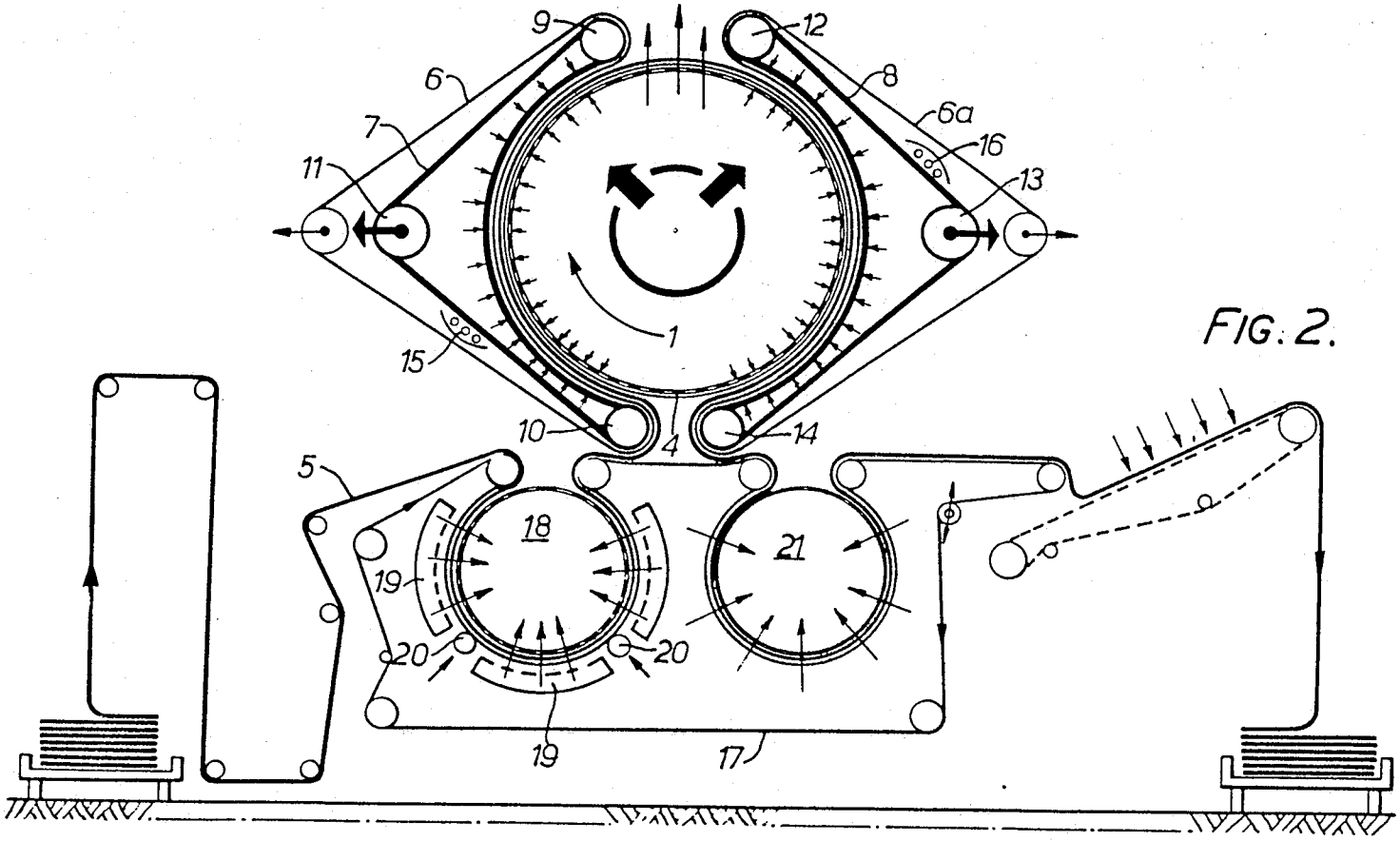
FIG. 2 is an elevation of a decatizing machine.

As shown in FIGS. 1 and 2 of the drawings, the decatizing machine comprises a decatizing cylinder 1, the wall 2 of which has a plurality of holes 3 distributed over its entire circumference. A sleeve 4 made of felt or other suitable material is arranged around the wall 2 of the decatizing cylinder 1.

The web of fabric material 5 to be decatized is interposed between two backing cloths 6, 6*a*. The backing cloths 6, 6a are applied against the material 5 during the decatizing process and are in the form of joint-free endless belts; they are made, for example, of satin fabric with a finely woven surface structure or of felt.

Associated with the decatizing cylinder 1 are two pressure strips 7, 8 which are impermeable to steam and which preferably consist of stainless steel; more than two pressure strips 7, 8 can be provided if desired. As may be seen from the drawings, each pressure strip 7, 8 presses against a respective backing cloth 6, 6a over an arc of less than 180°.

In the embodiment shown, the pressure strips 7 and 8 are endless, and extend around guide rollers 9, 10 and 11, and 12, 13, and 14 respectively. In this arrangement the rollers 11, 13 are tensioning rollers, so that the compressive force exerted by the pressure strips 7, 8 on the corresponding portion of the backing cloths 6, 6a is continuously adjustable. In order to achieve a good decatizing effect, the tension exerted on the backing cloths 6, 6a is advantageously at least 1.0 kg/cm².

The holes 3 in the wall 2 of the decatizing cylinder 1 are arranged to be connected to a source of steam (not shown) in such a manner that during the decatizing process the steam discharged into the sleeve 4 is evenly distributed and thus the material 5 is evenly moistened and heated. The pressure strips 7, 8 in addition to performing the required pressing action, have the task of preventing the entry of steam in the area of application onto the backing cloths 6, 6a, in such a manner that the steam discharged from the inside of the cylinder can flow through the material 5 and the backing cloths 6, 6a against the inner side of the pressure strips 7, 8. The pressure in the decatizing cylinder 1 is just high enough to overcome the resistance of the sleeve 4, of the material 5 and of the backing cloths 6, 6a, so that a surface pressure of at least 1 kg/cm² for the material 5 is maintained.

So as to obtain a decatizing effect on both sides and to prevent the formation of condensation, the pressure strips 7 and 8 are heated. This is achieved for example by means of heating devices 15, 16. However, the guide rollers 9, 10 and 12, 14 may also be heated in order to provide the same effect.

Prior to reaching the decatizing cylinder 1, the material 5 is moved around a steaming cylinder 18 by means of a backing cloth 17, preferably made of felt, and is subjected to the action of steam discharged from nozzle boxes 19. Pressure rollers 20 may be mounted between the individual nozzle boxes 19 to increase the surface pressure. After the material 5 has passed over the steaming cylinder 18 it is supplied to the decatizing cylinder 1. The material 5 is pressed on this decatizing cylinder 1 and is treated with steam. As can be seen in FIG. 2, there is no application of force on the material 5 by the pressure strips 7, 8 in the area between the two guide rollers 9, 12 so that the material 5 may regain volume until it reaches the following pressure strip 8. The free steam flow area thus created between the rollers 9, 12 is used for the constant renewal of the moisture content and to increase the decatizing effect, to improve the feel of the material as well as for the restoration of the volume of the material.

As soon as the material 5 has left the decatizing cylinder 1, it passes to a suction cylinder 21 which — when under a vacuum — effects a shock action on the one hand, and on the other hand a suction to remove the excess steam. This treatment of the material 5 also takes place with the application of pressure, this pressure being less than the pressure exerted by the pressure strips 7, 8.

Figure 3:
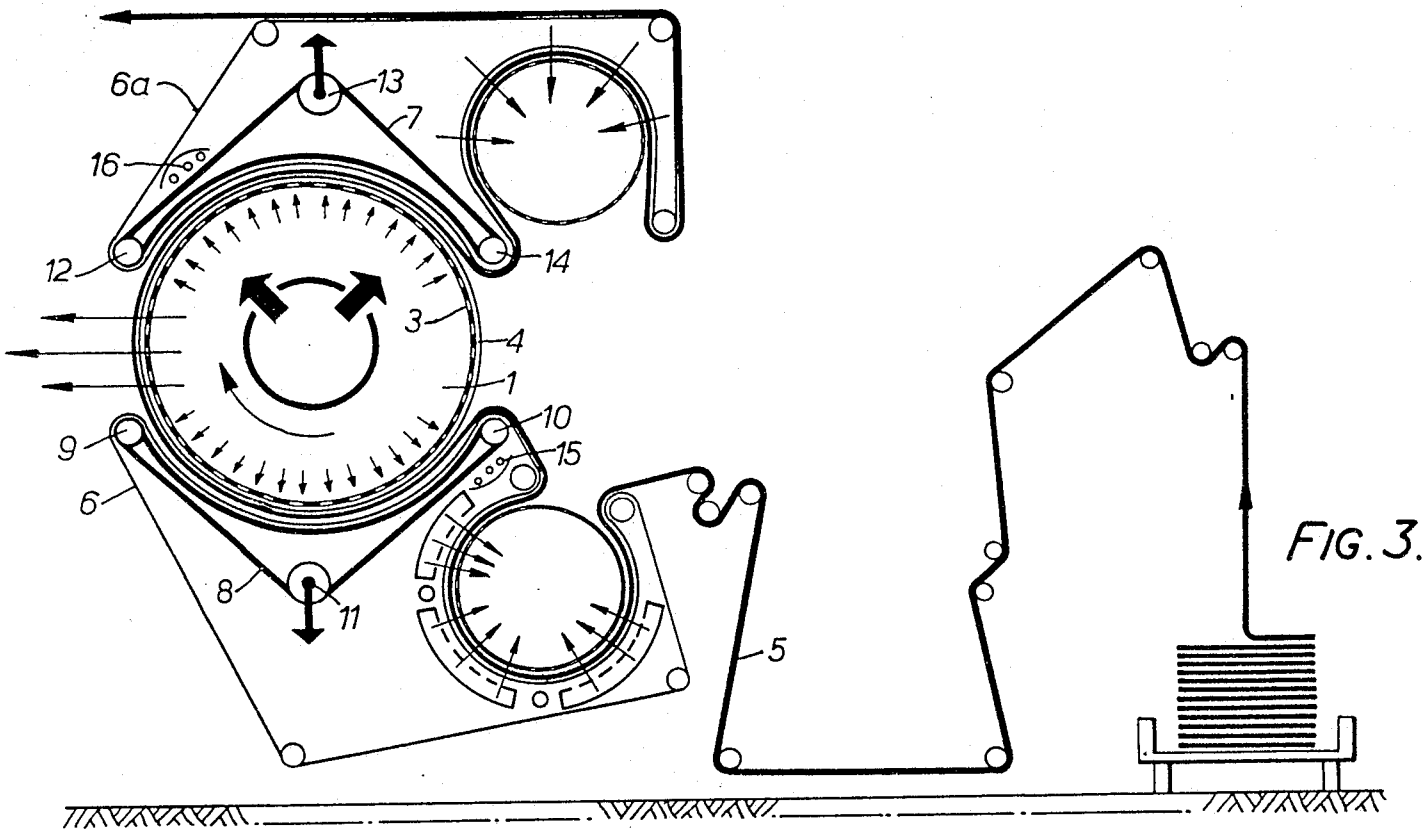
FIGS. 3 and 4 are elevations of modified forms of the machine.

The embodiment shown in FIG. 3 differs from that of FIG. 2 in that the two pressure strips 7, 8 are displaced clockwise by about 90° as compared with the arrangement according to FIG. 2 so that the pressure strip 7 lies above the pressure strip 8.

Figure 4:
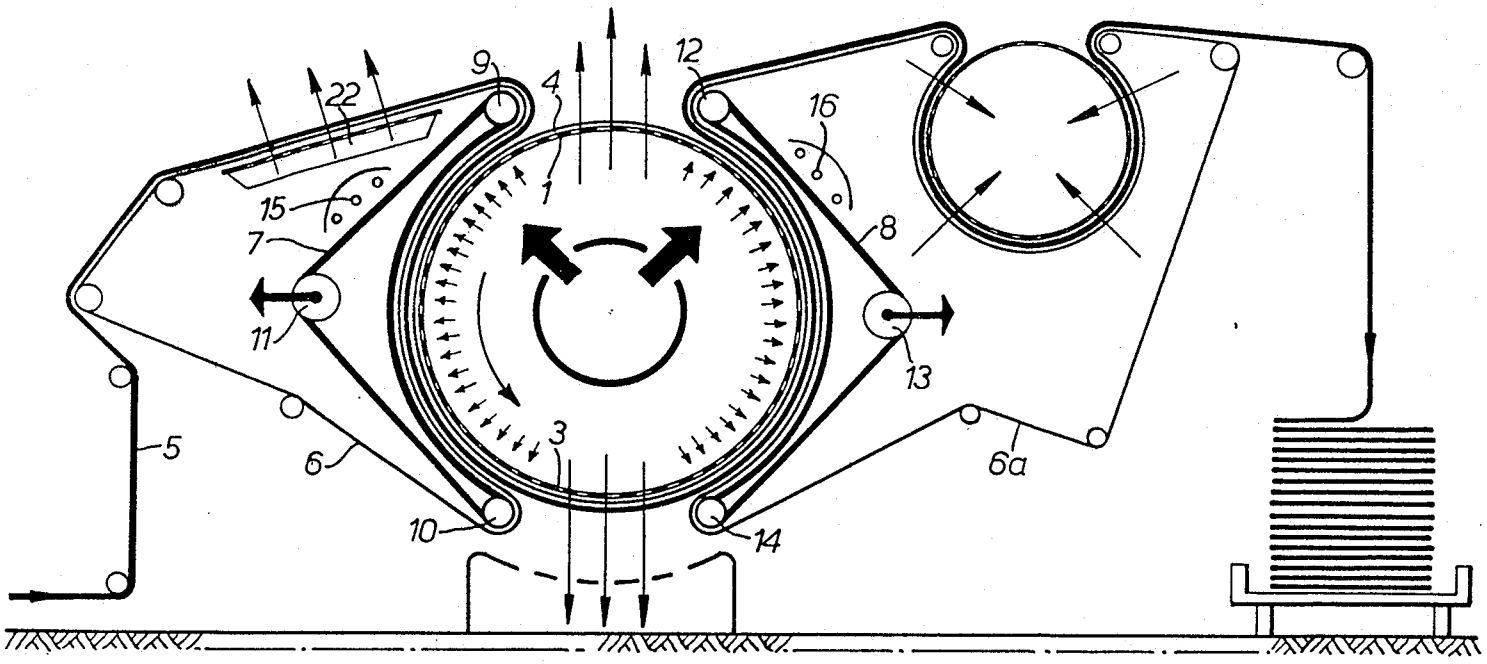

The embodiment shown in FIG. 4 substantially corresponds to that of FIG. 2 except that the material 5, before it is supplied to the decatizing cylinder 1, is fed over a steam nozzle box 22 and is moistened.

On switching off the material feed, the tensioning force in the pressure strips is released and the supply of steam is automatically shut down.

In the machine particularly described, as a result of the pressure strips which apply a high compressive pressure, e.g. of the order of 1 kg/cm², to the material a good and permanent decatizing effect is obtained on both sides of the material, while, as a result of the continuous feeding of steam during the decatizing process there are achieved in in addition a more pleasant feel of the material and good shrink stability throughout the material. Further, the material has a uniform and permanent gloss.

During the processing of the material on the decatising machine the material is evenly moistened by the application of steam, and brought to decatization temperature.

The range of the decatizing effect attainable by means of the treatment extends from a light finish decatization effect through the normal pressure gloss decatizing effect to the permanent kier or boiler decatizing effect, when the pressure applied by the strips reaches a maximum value.

What is claimed is:

1. In a continuous decatizing machine,
   - a rotatable, heatable, decatizing cylinder, the cylinder having a circumferential wall provided with holes distributed over the wall,
   - means for feeding steam to the decatizing cylinder such that said holes are fed with steam,
   - means for feeding material to be decatized around the cylinder,
   - backing cloths applied against the material around a portion of the cylinder, and
   - two heatable pressure strips, said strips being impermeable to steam, each said strip being applied against a respective backing cloth over an arc of less than 180°.

2. A machine according to claim 1, wherein each backing cloth is freely removable from its associated pressure strip.

3. A machine according to claim 2, wherein the backing cloths are in the form of endless, joint-free bands.

4. A machine according to claim 3, wherein the backing cloths are composed of a satin fabric.

5. A machine according to claim 1, further comprising
   - tensioning rollers, said pressure strips passing over the tensioning rollers.

6. A machine according to claim 5, wherein each pressure strip is composed of steel.

7. A machine according to claim 1, further comprising
   - a sleeve, said sleeve being disposed around the decatizing cylinder and being in direct contact therewith.

8. A machine according to claim 7, wherein the sleeve is a fabric sleeve.

9. In apparatus for continuously decatizing a fabric web, a decatizing cylinder mounted for rotation about its axis, said cylinder having a perforated circumferential wall, means for feeding steam to the interior of the cylinder, means operative to feed the fabric web around the circumferential wall of the cylinder, first and second backing cloths engaging the outer surface of the web around the cylinder, and first and second pressure-applying strips associated with the backing cloths, said strips contacting the associated backing cloths and applying pressure to the backing cloths to force the cloths into contact with the web on the cylinder, said strips being impermeable to steam, and being spaced circumferentially around the cylinder to define a gap therebetween for discharge of steam through the web to the surrounding atmosphere.

* * * * *